United States Patent [19]

Zedrosser et al.

[11] Patent Number: 4,941,394

[45] Date of Patent: Jul. 17, 1990

[54] HAND-HELD AUTOMATIC FIREARM

[75] Inventors: Ulrich Zedrosser; Walter Schwarz, both of Steyr, Austria

[73] Assignee: Steyr-Daimler-Puch AG, Vienna, Austria

[21] Appl. No.: 404,114

[22] Filed: Sep. 7, 1989

[30] Foreign Application Priority Data

Sep. 28, 1988 [AT] Austria ..... 2390/88

[51] Int. Cl.[5] ..... F41A 19/02

[52] U.S. Cl. ..... 89/129.02; 89/141; 89/142

[58] Field of Search ..... 89/129.02, 139, 140, 89/141, 142, 144, 145

[56] References Cited

U.S. PATENT DOCUMENTS 4,745,843 5/1988 Zedrosser et al. ..... 89/132

FOREIGN PATENT DOCUMENTS 0123871 11/1984 European Pat. Off. .
579096 6/1933 Fed. Rep. of Germany ..... 89/140
2323352 11/1974 Fed. Rep. of Germany .
3227180A1 1/1984 Fed. Rep. of Germany .

*Primary Examiner*—Stephen C. Bentley
*Attorney, Agent, or Firm*—Marmorek, Guttman & Rubenstein

[57] ABSTRACT

The trigger mechanism of a hand-held automatic firearm comprises a catch lever, which is pivoted on a transverse axis and is provided at its forward end with a pivoted catch pawl, which in a catching position engages a catching lug of a slider to arrest the slider as it moves forwardly from a rear position, to which the slider, which constitutes a part of a firing mechanism of the firearm, has moved against spring force when a round has been discharged. In order to provide such a firearm which has a trigger mechanism which is reliable in operation and can be made at low cost, the catch lever is adapted to be locked in its catching position against the force of a catch lever spring, the catch pawl is pivoted to the catch lever by means which permit a longitudinal movement of the catch pawl and the catch pawl is pivotally supported at its other end on an abutment, which is fixed to the receiver of the firearm.

6 Claims, 5 Drawing Sheets

HAND-HELD AUTOMATIC FIREARM

BACKGROUND OF THE INVENTION

1. Field of the Invention

This invention relates to a hand-held automatic firearm, particularly to a trigger mechanism for such firearm, which mechanism comprises a catch lever, which is pivoted on a transverse axis and is provided at its forward end with a pivoted catch pawl, which in a catching position engages a catching lug of a slider to arrest the slider as it moves forwardly from a rear position, to which the slider, which constitutes a part of a firing mechanism of the firearm, has moved against spring force when a round has been discharged.

2. Description of the Prior Art

In firearms provided with such trigger mechanism the slider, which may consist of a breechblock or of a carriage which by means of a cam mechanism cooperates with a transversely displaceable firing chamber or another part of the firing mechanism is restrained from performing a forward movement which would be required for the discharge of a round and is released only from time to time for the discharge of a round. To restrain the slider, the catch pawl is pivotally moved into the path of the slider to catch the slider as it tends to advance under its spring bias. As is apparent from U.S. Pat. No. 4,745,843 the catch pawl, which is pivoted to the catch lever, is supported relative to the catch lever and relative to a trigger housing and the catch pawl itself constitutes a member which controls the movement of the catch lever to its catching position and to its releasing position. That arrangement involves a considerable structural expenditure and the loads which are applied by the slider to the catch pawl must also be taken up by the catch lever and by the pivotal mountings for the pawl and the catch lever. Because said loads are suddeenly applied, they require that the materials, the shapes and the dimensions of the parts which cooperate to catch the slider are properly selected. The parts must be made of high-strength materials, particularly of hardened steel, so that the parts are heavy and can be manufactured and particularly machined only with difficulty. Nevertheless, very strong forces, which may be exerted, e.g., when the firearm falls on the ground, may result in an inadvertent release of the slider so that a round is inadvertently discharged.

EP-A No. 1-0 121 871 and Published German Application No. 23 23 352 disclose trigger mechanisms which comprise spring-loaded catch pawls, which are pivoted directly to the trigger housing and serve to catch the breechblock. Said catch pawls are operable by means of a lever, which cooperates with the trigger. That lever is also spring-loaded and either has a nose which enters a recess of the catch pawl or is connected to the catch pawl by a rotatable pinion, which upon an actuation of the trigger is pivotally moved to move the catch pawl to a releasing position against the force of the catch pawl spring. As the trigger is released, said lever is swung back by spring force so that the catch pawl can jump up to its catching position. Special controlling means including separate control levers, which protrude into the path of the breechblock, are provided and ensure that the release of the catch pawl will be performed exactly when the breechblock has moved to the desired position and that the catching position will properly be assumed. In such an arrangement the loads which are applied to the catch pawl as the breechblock is caught can directly be transmitted by the catch pawl to the trigger housing but the mechanisms described are heavy and expensive and intended for use in automatic cannons and cannot be incorporated in hand-held firearms.

Published German Application No. 32 27 180 discloses self-loading pistols in which the loading mechanism comprises an actuating lever, which engages a two-armed lever that is approximately parallel to the path for the breechblock, one arm of the two-armed lever cooperates with a pivoted breechblock locking member and the other arm of the two-armed lever cooperates with a acatch pawl associated with the striking hammer. In such an arrangement the breechblock locking member is forced upwardly into the path for the breechblock by a nose of the magazine and after the discharge of the last cartridge catches the breechblock in its rear position. In that case the operating lever can be operated so that the two-armed lever will cause the breechblock to be released and the striking hammer to be uncocked. Said self-loading pistols are single-round firearms, in which the trigger is not directly connected to the loading means and in which an actuation of the trigger will cause the striking hammer to be cocked and when a release position has been reached to be released for the discharge of a round independently of the operating lever and the two-armed lever.

SUMMARY OF THE INVENTION

For this reason it is an object of the invention to eliminate said disadvantages and to provide a hand-held automatic firearm which is of the kind described first hereinbefore and comprises a trigger mechanism which is simpler in design and can be manufactured at lower cost and will be highly reliable in operation even though lightweight materials are widely employed.

That object is accomplished in accordance with the invention in that the catch lever is adapted to be locked in its catching position against the force of a catch lever spring, the catch pawl is pivoted to the catch lever by means which permit a longitudinal movement of the catch pawl and the catch pawl is pivotally supported at its other end on an abutment, which is fixed to the receiver of the firearm. Because a separate catch pawl is provided to arrest and retain the slider and said catch pawl is connected to the catch lever by a lost-motion coupling and for taking up a load is directly supported by a rigid abutment, which is fixed to the receiver of the firearm, the catching and retaining forces which are exerted will substantially be transmitted by the catch pawl directly to the abutment so that the catch lever will be relieved from substantial loads and serves virtually only as a lever for operating the catch pawl. For this reason only the catch pawl must be made of a high-strength material and the catch lever and most of the other components of the trigger mechanism may be made from lighter materials: Besides, the specific combination of the catch lever and the catch pawl will ensure a more reliable catching because when the catch pawl has been pivotally raised from the catch lever into the path of the catching lug of the slider the slider will tend to further raise the catch pawl to assist its catching function so that the reliability in operation will not adversely be affected even in case of a deformation of the catching lug or the catch pawl.

For a discharge of single rounds and for a sustained fire the catch lever usually cooperates with a releasing member, a disconnector and with a locking lever. In such firearms, a particularly desirable arrangement will be obtained if a straight two-armed catch lever is provided, which is approximately parallel to the path for the slider and at its forward lever arm carries the catch pawl whereas its rear lever arm is provided with a locking lug for engaging the releasing member and the disconnector, the trigger is longitudinally slidable and is spring-loaded and provided with a releasing nose so that the trigger constitutes also the releasing member the disconnector is spring-loaded and comprises a disconnecting nose and is pivoted to the slidable trigger, the releasing nose and the disconnecting nose in an operative position overlap the locking lug, the locking lever in its locking position limits the pivotal movement of the disconnector before it reaches its operative position, and a transversely slidable safety slide is provided, which is provided with camming surfaces, which serve to displace the locking lever out of its locking position against the force of a locking lever spring when said safety slide is in a single-round position, permit the locking lever to move to said locking position when said safety slide is in a sustained-fire position, and to lock the trigger in an initial position when the safety slide is in a safety position. Such a trigger mechanism will be compact and the trigger will be operable by the operator under the same conditions for single rounds and for a sustained fire. When the trigger has been unlocked, the operator can simply pull the trigger and in dependence on the position of the safety slide will effect a discharge of single rounds or discharge a sustained fire. By means of the safety slide, the locking lever is enabled and/or disabled and by means of the locking lever the disconnector will be enabled and disabled so that the disconnector will arrest the catch lever independently of the trigger after the discharge of each round or will cause the catch lever to be released only by the releasing nose of the trigger for a discharge of a sustained fire. The provision of a slidable trigger and the provision of a single member which constitutes the trigger and the releasing member result in a relatively simple and robust arrangement, which is particularly reliable in operation.

The trigger and the disconnector cannot perform the assigned functions unless they are spring-loaded. The trigger is spring-urged to its initial position and the disconnector is spring-urged to its catching position. Within the scope of the invention the trigger and the disconnector may be biased by a common spring so that the arrangement is further simplified. That spring is suitably secured to slidable trigger and bears at one end on a stationary part of the trigger mechanism and at its other end on the disconnector, which consists of a lever.

It may be desirable to discharge a sustained fire consisting of an exactly predetermined number of rounds. For that purpose it is known that trigger mechanisms may be provided with a burst size control mechanism. In a particularly desirable embodiment of the invention the burst size control mechanism comprises a torsionally spring-loaded control disk, which is rotatably mounted in the slidable trigger and is provided on one side with ratchet teeth for cooperating with a spring-loaded locking pawl, which is mounted on the receiver of the firearm, and the disk is provided on the other side with drive teeth for cooperating with a spring-loaded actuating pawl, which is pivoted to the trigger. The actuating pawl is operable by an actuating lug of the catch lever and that ratchet tooth which is the leading ratchet tooth during a forward rotation of the control disk constitutes an elevated stop for engagement by a coupling portion of the locking lever. When the safety slider is in its sustained-fire position, the catch lever will not be locked after each round but under the control of the reciprocating slider will permit a sustained fire. In that case the actuating lug of the catch lever will operate the actuating pawl to rotate the control disk by one tooth pitch after each round until the ratchet tooth which constitutes an elevated stop lifts the locking lever from its locking position so that the interrupter is released and the burst will be terminated. In said control operations the locking pawl will prevent an unintended reverse rotation of the control disk and will ensure that the control disk will be rotated by one tooth pitch and that the burst will reliably be terminated after rounds have been discharged in a number which equals the number of teeth. When the burst has been terminated in that the disconnector has been released to lock the catch lever in its catching position after the discharge of the last round, the trigger will have to be released for the discharge of the next round so that the slidable trigger will then move forwardly to move the control disk out of the path of the locking pawl. The control disk can then reversely be rotated to its initial position and the release member and the disconnector will obviously also move to their initial position. In dependence on the position of the safety slide another actuation of the trigger will then result in the discharge of a single round or of a predetermined number of rounds.

Within the scope of the invention the structural expenditure and the space requirement may be decreased in that the disconnector and the control disk are coaxially mounted on the slidable trigger and the control disk and the locking pawl may be biased by a single spring. The manufacturing costs may further be reduced within the scope of the invention in that only the pivot pins, bearing bushings, springs and similar small parts and the catch pawl are made of metal whereas the remaining parts of the trigger mechanism are made of plastic so that the weight will be reduced and the impact forces to be taken up will be damped.

DETAILED DESCRIPTION OF THE PREFERRED EMBODIMENT

Figure 1:
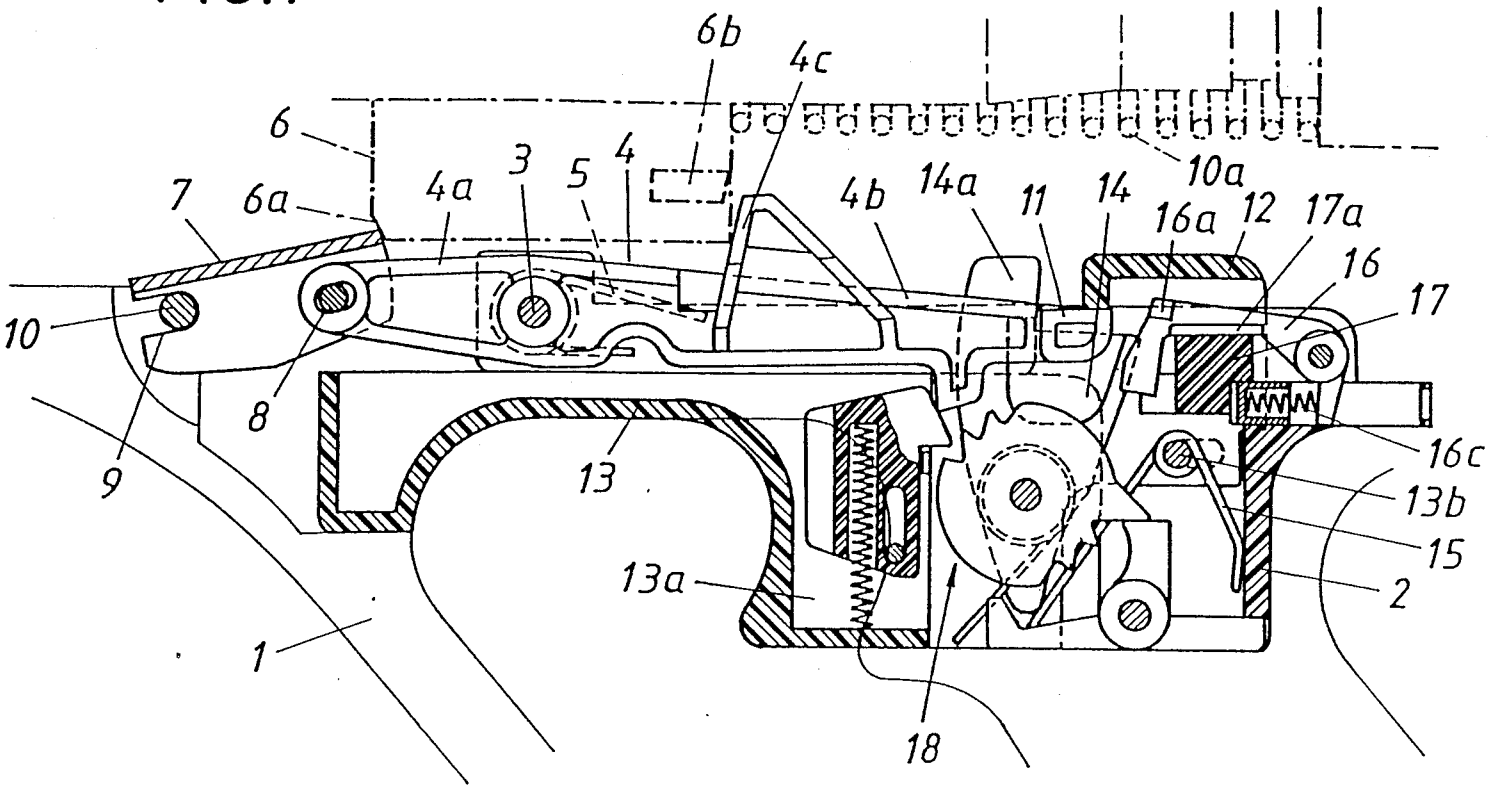
FIGS. 1 to 3 are fragmentary side elevations showing partly in section a portion of a firearm embodying the invention and provided with a trigger mechanism in three different operating positions for a discharge of a single round.

An illustrative embodiment of the invention will now be described more in detail with reference to the diagrammatic drawing.

A hand-held firearm 1 comprises a stationary receiver 2, in which a straight two-armed catch lever 4 is pivoted on a transverse pivot 3 and is biased by a catch lever spring 5 toward a position in which it is clear of the path of a slider 6. That slider is only diagrammatically indicated and cooperates with the firing mechanism, not shown, of the firearm 1 and is reciprocable in the longitudinal direction of the barrel. The forward lever arm **4*a* of the catch lever 4 is provided with a catch pawl 7** for cooperating with an associated catch lug 6a of the slider 6, which is biased forwardly by a spring 10a, which is directly supported on the receiver 2 of the firearm. The catch pawl 7 is mounted in the catch lever 4 in a longitudinally extending slot 8 for a lost motion in the longitudinal direction and is formed with a bearing recess 9, which is pivotally supported on an abutment 10 that is fixed to the receiver 2. As a result, the impact forces which are exerted as the slider 6 moving forwardly by the spring 10a is caught by the catch pawl will also be substantially applied by the catch pawl 7 directly to the receiver 2 of the firearm 1 whereas the catch lever 4 and the remainder of the trigger mechanism will be substantially relieved from such forces.

The rear lever arm 4b of the catch lever 4 is provided with a locking lug 11, which cooperates with a releasing nose 12 of the slidable trigger 13, which constitutes a releasing member and comprises a pushpiece portion 13a. The locking lug 11 also cooperates with a disconnector nose 14a of a disconnector 14, which is pivoted to the pushpiece portion 13a. A common spring 15 biases the disconnector 14 in a catching direction and biases the pushpiece portion 13a to oppose the pulling of the trigger. That trigger spring 15 consists of a coiled torsion spring, which is mounted on a guide pin 13b of the pushpiece portion 13a and has end legs which are respectively supported on the receiver 2 and the disconnector 14.

A locking lever 16 is pivoted in the receiver 2 and limits the pivotal movement of the disconnector. As a result, the locking lever 16 can be operated to enable and disable the disconnector 14. The locking lever 16 is operable by a transversely adjustable safety slide 17, which is movable to a safety position, in which the safety slider 17 locks the trigger 13 in its initial position, to a single-round position, in which the safety slide 17 holds the locking lever 16 out of its operative position, and to a sustained-fire position, in which the safety slide permits the locking lever to move to its operative position. For that purpose the safety slide 17 is provided with camming surfaces 17a, 17b and the locking lever 16 is biased by a locking lever spring 16c against said camming surfaces so that the locking lever 16 will be raised or lowered in response to the movement of the safety slide 17 and stops 16a provided on the locking lever 16 and limiting the movement of the disconnector 14 are moved into and out of the path for the disconnector 14.

Figure 2:
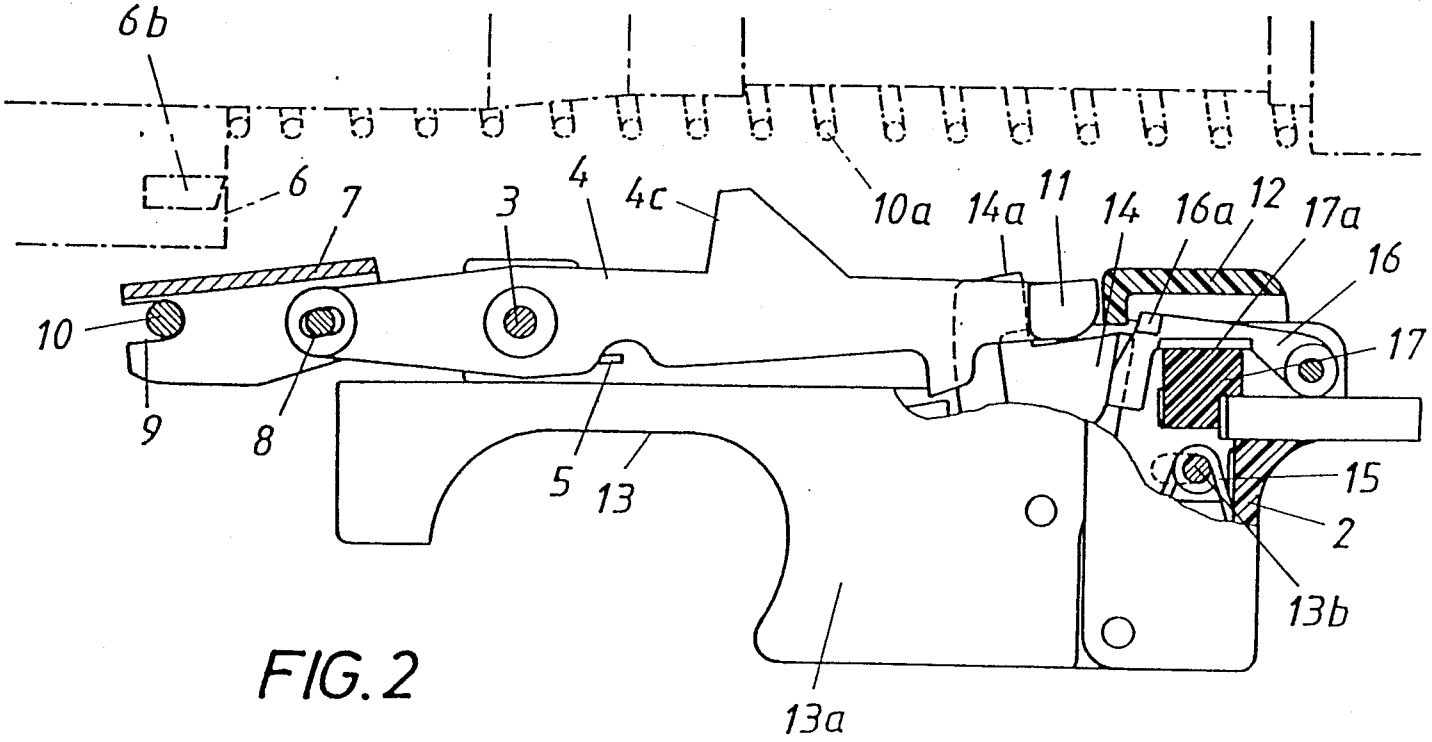
Figure 3:
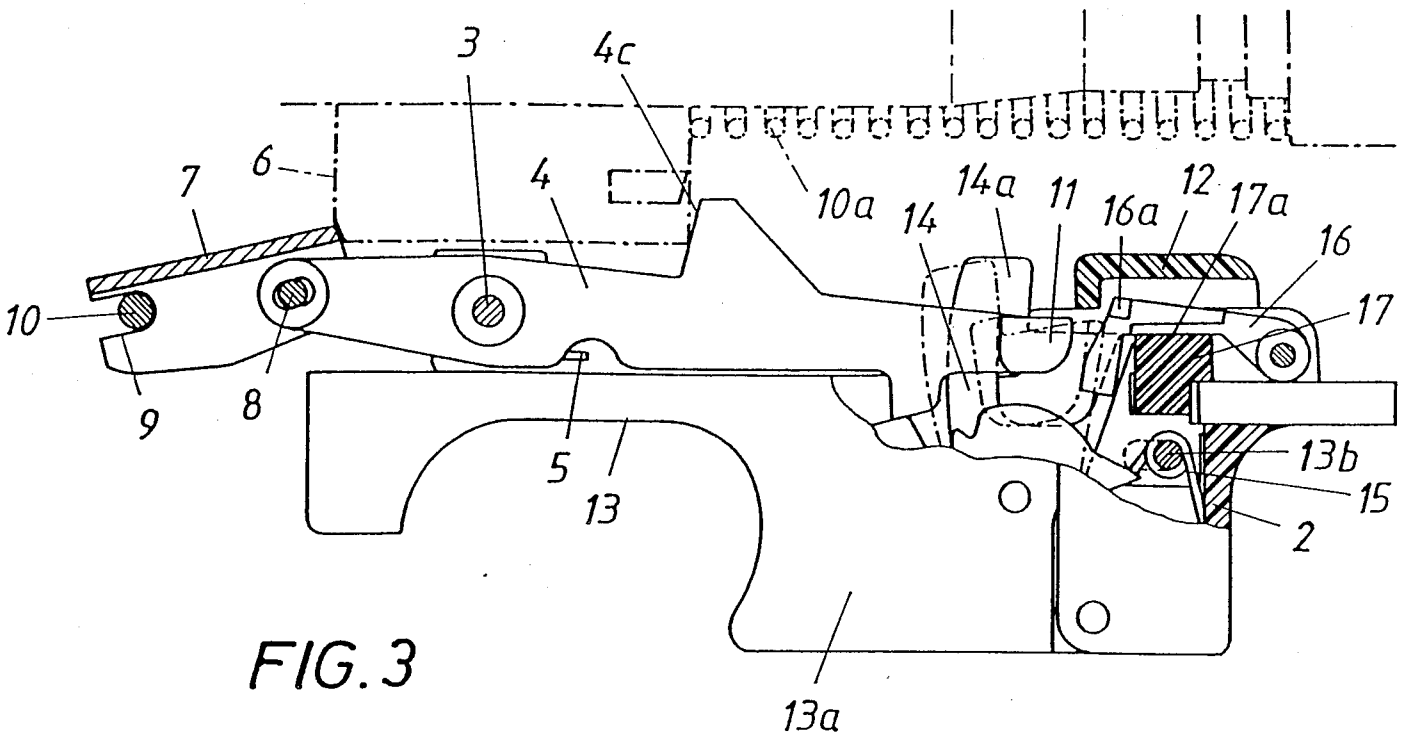

The discharge of single rounds will now be explained with reference to FIGS. 1 to 3. When the safety slide 17 is in its single-round position, the stops 16a of the locking lever 16 are disposed outside the range of the disconnector 14. In the initial position the catch lever 4 is initially locked in its catching position by the engagement of the releasing nose 12 and the locking lug 11 and the catch pawl 7 supported by the abutment 10 has been pivotally raised into the path for the slider so that when the slider 6 tends to move forwardly its catching lug 6a will engage the catch pawl 7 to arrest the slider 6 before it reaches its foremost position (FIG. 1). When the trigger 13 is then actuated, the releasing nose 12 will release the locking lug 11 and the spring 5 will pivotally actuate the catch lever 4 to raise the rear lever arm 4b and to lower the forward lever arm 4a to move the catch pawl 7 to its inoperative position. The slider 6 can then be moved forwardly to its foremost position and a round will be discharged (FIG. 2). After the round has been discharged, the slider 6 is thrown back, e.g., by a gas drive, not shown, which is actuated by the propellant gases which have been produced. The slider 6 is provided with a control lug 6b, which during the return of the slider 6 cooperates with a suitable ramp surface 4c of the catch lever 4, which is thus forced back against the force of the catch lever spring 5 until the disconnecting nose 14a of the disconnector 14, which is biased by the spring 15, can snap behind the locking lug 11 during its reverse pivotal movement to lock the catch lever 4 in its catching position. During the reverse pivotal movement of the catch lever 4, the catch pawl 7 is also pivotally raised into the path for the slider so that as the slider 6 has been reversed and moves forwardly again its catching lug 6a will again strike against the catch pawl to stop the movement of the slider and a discharge of another round will thus be prevented. The disconnector 14 locks the catch lever 4 when the trigger 13 has been pulled and the releasing nose 12 is out of reach so that only a single round can be discharged (FIG. 3). As soon as the trigger 13 has been released, the spring 15 will push the trigger portion 13a to its initial position so that the releasing nose 12 snaps behind the locking lug 11 to lock the catch lever 4 before the disconnecting nose 14a of the disconnector 14, which is moved in unison with the trigger 13, is disengaged from the locking lug 11. Now the initial position has been reached and the next round can be discharged (FIG. 1).

Figure 4:
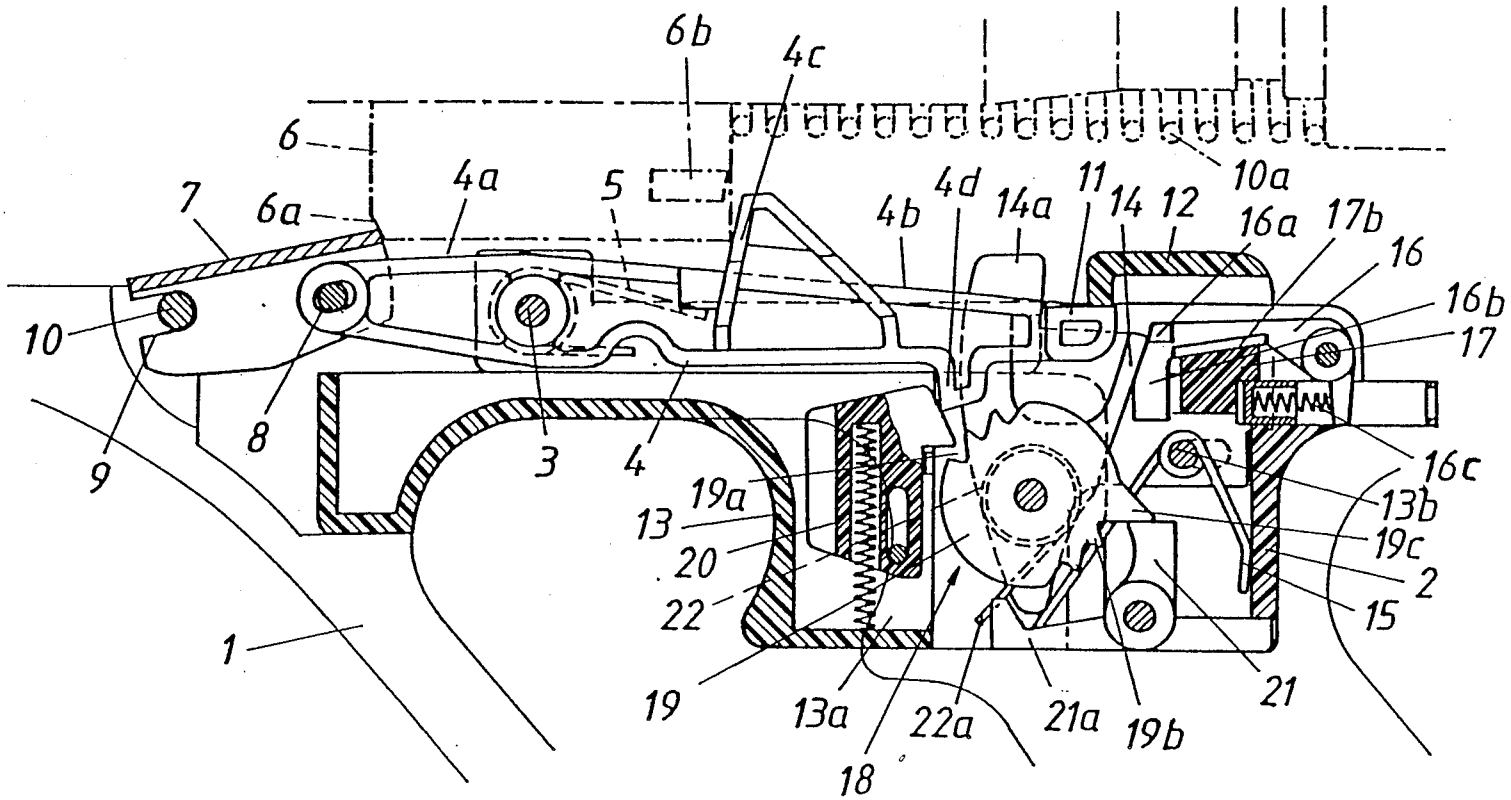
FIGS. 4 to 7 are fragmentary side elevations showing partly in section a firearm embodying the invention and provided with a trigger mechanism in four different operating positions during a sustained fire.
Figure 5:
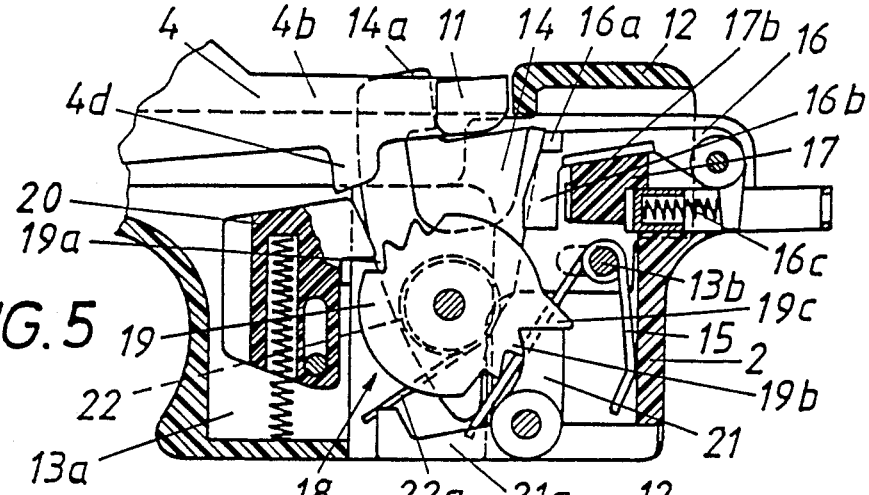
Figure 6:
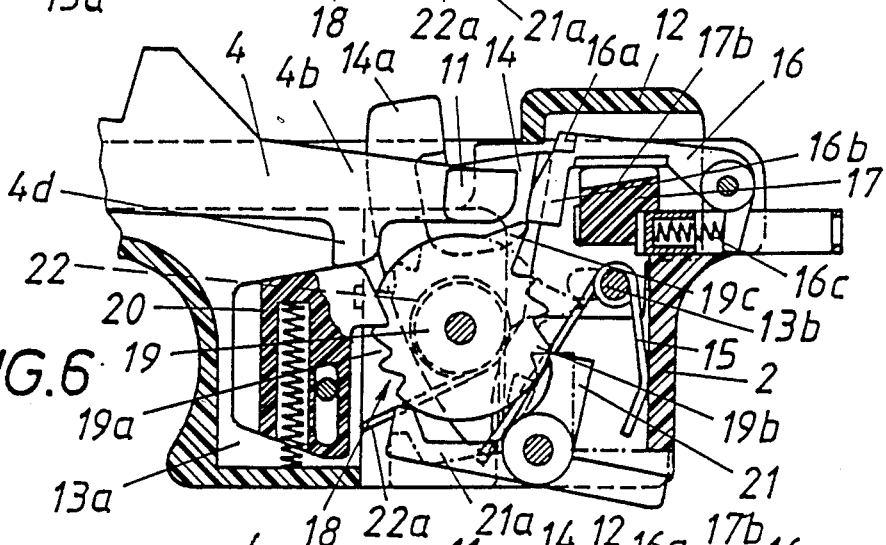

The use of the firearm 1 for sustained fire is illustrated in FIGS. 4 to 7. The safety slider 17 is in its sustained-fire position, in which the camming surface 17b engages the locking lever 16 in its locking position so that the locking stop 16a prevents a pivotal movement of the disconnector 14 as far as to its disconnecting position. When the trigger 13 has been pulled for the discharge of a round the catch lever 4 is swung back after the discharge of the round and the catch lever 4 is no longer locked when it has been swung back because the locking lug 11 of the catch lever 4 cannot be engaged by the releasing nose 12 or by the disconnecting nose 14a and because the catch lever 4 is unlocked it will not interrupt the forward movement of the slider 6 but by said forward movement will be pivotally raised automatically. Consecutive rounds will now be discharged as long as the trigger 13 is pulled and the releasing nose 12 remains retracted (FIGS. 5 and 6). Only when the trigger 13 has been released is the releasing nose 12 moved into the range of the locking lug 11 so that the catch lever 4 can no longer be pivotally raised but will prevent a release of the slider 6 and the discharge of another round.

In order to limit the burst of sustained fire, e.g., to three consecutive rounds, the trigger mechanism is provided with a burst size control mechanism 18. That control mechanism comprises a spring-loaded control disk 19, which is mounted in the slidable trigger 13 for rotation on the same axis as the disconnector 14. A spring-loaded actuating pawl 20 is pivoted to the trigger and a spring-loaded locking pawl 21 is pivoted to the receiver. The actuating pawl 20 cooperates with drive teeth 19a of the control disk 19 and is operable by an actuating lug 4d of the catch lever 4. The locking pawl 21 cooperates with the ratchet teeth 19b of the control disk 19. That of said ratchet teeth 19b which is the leading ratchet tooth during a rotation of the control disk 19 in a forward sense constitutes an elevated stop 19c for cooperation with a coupling member 16b of the locking lever 16. In its sustained-fire position the safety slide 17 permits the locking lever 16 to move to its locking position and the disconnector 14 will remain ineffective as long as the pivotal movement of the disconnector is limited by the locking stops 16*a* of the locking lever 16. The catch lever 4 is held in its initial position by the disconnecting nose 12 of the trigger 13. The locking pawl 21 supports the control disk 19 at its stop 19*c* against the action of the return spring 22, which by means of an end leg 22*a* biases the arm 21*a* of the locking pawl 21. The actuating pawl 20 is outside the range of the actuating lug 4*d* (FIG. 4). Upon an actuation of the trigger 13, the releasing nose 12 will release the catch lever 4 and the actuating pawl 20 will be pushed under the actuating lug 4*d* and the locking pawl 21 will reach its locking position for cooperating with the ratchet teeth 19*b*. When the catch lever 4 is now swung back after the discharge of each round, the actuating lug 4*d* will depress the actuating pawl 20 into engagement with the drive teeth 19*a* so that the control disk 19 will be rotated by one tooth pitch after the discharge of each round. A reverse rotation of the control disk 19 by the return spring 22 is prevented by the locking pawl 21, which like the actuating pawl 20 snaps behind the next following tooth after the discharge of each round (FIG. 6).

Figure 7:
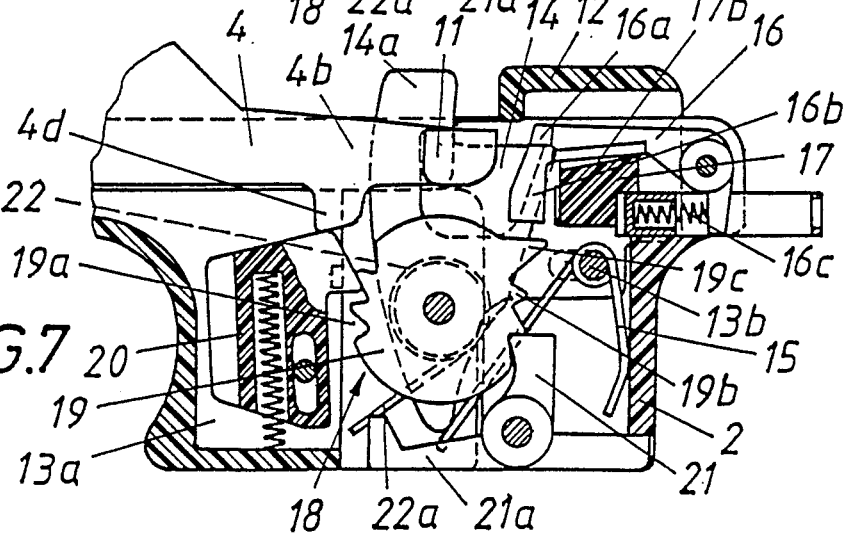

After the discharge of the third round the control disk 19 has been rotated to such an extent that the stop 19*c* has raised the coupling lug 16*b* of the locking lever 16, which has thus been moved out of its locking position so that the disconnector 14 can pivotally move to its disconnecting position and the disconnecting nose 14*a* snaps behind the locking lug 11 of the rearwardly moving catch lever 4, which is thus locked in its catching position (FIG. 7). The burst has thus been terminated and before shooting can be resumed the trigger 13 must be released so that the releasing nose 12 again snaps behind the locking lug 11 before the disconnecting nose 14*a* slips off. Because the actuating pawl 20 and the control disk 19 are moved in unison with the trigger, the ratchet teeth 19*b* are disengaged from the locking pawl 21 and the control disk 19 is reversely rotated until the stop 19*c* engages the pawl 21 so that the initial position shown in FIG. 4 has been reached. In dependence on the position of the safety slide 17, a renewed actuation of the trigger 13 will result in the discharge of a single round or in sustained fire or the trigger 13 cannot be actuated at all when the safety slider is in its safety position.

We claim:

1. A hand-held automatic firearm comprising a receiver, which defines a slider path extending in a longitudinal direction, a firing mechanism, which is mounted in said receiver and is operable to discharge a round and comprises a slider, that comprises a catching lug and is mounted in said receiver to be movable along said slider path forwardly from a rear position and rearwardly to said rear position, a slider spring, which biases said slider forwardly along said path, and a trigger mechanism including a catch lever, which is pivoted in said receiver on an axis which is transverse to said longitudinal direction, which catch lever is pivotally movable to and from a catching position and has a forward end portion, and a catch pawl, which is pivoted to said forward end portion of said catch lever and engages said catching lug to arrest said slider as it moves forwardly from said rear position when said catch lever is in said catching position, a catch lever spring, which urges said catch lever away from said catching position, catch lever locking means for locking said catch lever in said catching position against the force of said lever spring, an abutment fixed to said receiver, and said catch pawl having a first end portion, which is pivoted to said catch lever for a lost motion generally in said longitudinal direction, and a second end portion, which is pivotally supported on said abutment.

2. The firearm set forth in claim 1 in which said trigger mechanism comprises a releasing member, a disconnector and a locking lever, wherein said catch lever is a straight, two-armed lever extending generally in said longitudinal direction and having forward and rear lever arms, said catch pawl is pivoted to said forward lever arm, said rear lever arm is provided with a locking lug, which is engageable by said releasing member and said disconnector, said trigger mechanism comprises a trigger, which is under a trigger spring bias and is slidably mounted in said receiver for a movement in said longitudinal direction and constitutes a releasing member provided with a releasing nose and is rearwardly movable from an initial position against said trigger spring bias to permit said releasing nose to engage said locking lug, said disconnector is pivoted to said trigger and comprises a disconnecting nose and is under a disconnector spring bias and is movable against said disconnector spring bias to a disconnecting position to permit said disconnecting nose to engage said locking lug, said locking lever is movable to a locking position and in said locking position is arranged to prevent a movement of said disconnector to said disconnecting position, a locking lever spring is provided, which urges said locking lever to said locking position, a safety slider is slidably mounted in said receiver and accessible from the outside of said firearm and is manually movable transversely to said longitudinal direction to a single-round position, a sustained-fire position and a safety position and is provided with camming surfaces for cooperating with said locking lever and with said trigger to keep said locking lever away from said locking position against the force of said locking lever spring when said safety slider is in said single-round position, to permit said locking lever to move to said locking position when said safety slider is in said sustained-fire position, and to lock said trigger in said initial position when said safety slide is in said safety position.

3. The firearm set forth in claim 2, wherein a common spring is provided for exerting said trigger spring bias and said disconnector spring bias.

4. The firearm set forth in claim 2 further comprising a burst size control mechanism, wherein said burst size control mechanism comprises a control disk, which is mounted in said trigger for rotation in mutually opposite, forward and reverse senses and is under a torsional spring bias acting in said reverse sense, ratchet teeth carried by said control disk on one side thereof, drive teeth carried by said control disk on the other side thereof, and a spring-loaded locking pawl, which is mounted in said receiver for cooperation with said ratchet teeth to prevent a rotation of said control disk in said reverse sense while permitting a rotation of said control disk in said forward sense, a spring-loaded actuating pawl, which is mounted in said trigger for cooperation with said drive teeth, and wherein said locking lever is provided with an actuating lug for cooperating with said actuating pawl to rotate by means of said actuating pawl said control disk by one tooth pitch of said drive teeth in said forward sense by the cooperation of said actuating pawl with said drive teeth against the action of said locking pawl after the discharge of a round when said safety slide is in said sustained-fire position, and one of said ratchet teeth is a leading ratchet tooth during a rotation of said control disk in said forward sense and protrudes radially beyond at least one additional one of said ratchet teeth, said locking lever comprises a coupling member for engaging said stop, and said trigger is arranged to hold said ratchet teeth out of engagement with said locking pawl when said trigger is in said initial position.

5. The firearm set forth in claim 4, wherein said disconnector and said control disk are mounted on said trigger for a movement about a common axis.

6. The firearm set forth in claim 4, which comprises a common spring for biasing said control disk to rotate in said reverse sense and for biasing said locking pawl toward said ratchet teeth.

* * * * *